United States Patent [19]

Matas Gabalda

[11] 4,315,397

[45] Feb. 16, 1982

[54] DEVICE FOR TWISTING A YARN BY MEANS OF A DOUBLE TWIST DEVICE

[75] Inventor: Carlos Matas Gabalda, Granges-les-Valence, France

[73] Assignee: ASA S.A., France

[21] Appl. No.: 144,841

[22] Filed: Apr. 29, 1980

[30] Foreign Application Priority Data

May 4, 1979 [FR] France ..... 79 11943

[51] Int. Cl.[3] ..... D01H 7/86

[52] U.S. Cl. ..... 57/58.49; 57/58.83; 57/58.84

[58] Field of Search ..... 57/58.49, 58.76, 58.83, 57/58.84, 58.86

[56] References Cited

U.S. PATENT DOCUMENTS

| | | | |
|---|---|---|---|
| 2,939,268 | 6/1960 | Rehn | 57/58.83 |
| 3,066,472 | 12/1962 | Klein | 57/58.83 X |
| 3,475,892 | 11/1969 | Taira et al. | 57/58.84 X |
| 3,481,134 | 12/1969 | Whewell, Jr. | 57/58.84 X |
| 3,685,269 | 8/1972 | Matas-Gabalda | 57/58.83 |

FOREIGN PATENT DOCUMENTS

| | | | |
|---|---|---|---|
| 571112 | 2/1933 | Fed. Rep. of Germany | 57/58.84 |
| 878641 | 10/1942 | France | 57/58.83 |
| 885434 | 5/1943 | France | 57/58.84 |

*Primary Examiner*—John Petrakes

*Attorney, Agent, or Firm*—Arnold, White & Durkee

[57] ABSTRACT

A double twist spindle comprising a shaft adapted to be rotatably driven, the shaft having a first end to be supported on a machine frame, a package carrying assembly rotatably mounted at the opposed end of the shaft for rotation independently of the shaft, the assembly including a base for supporting an end of a bobbin, a hollow axle co-axial with the shaft, and a magnet for retaining the assembly against rotation with the shaft, and a bowl element fixed to the second end portion of the shaft for rotation with the shaft. The bowl element comprises a hollow bowl which is co-axial with the shaft, which extends around the package carrying assembly, and which has a conduit defining a yarn passage with a yarn outlet. The hollow bowl has a first part which is of truncated conical shape in the region of the yarn outlet, the first part having a gradual slope, and has a further part which extends from the diverging end of the first part, the first part having a concave bell mouthed configuration.

6 Claims, 3 Drawing Figures

Figure 3:
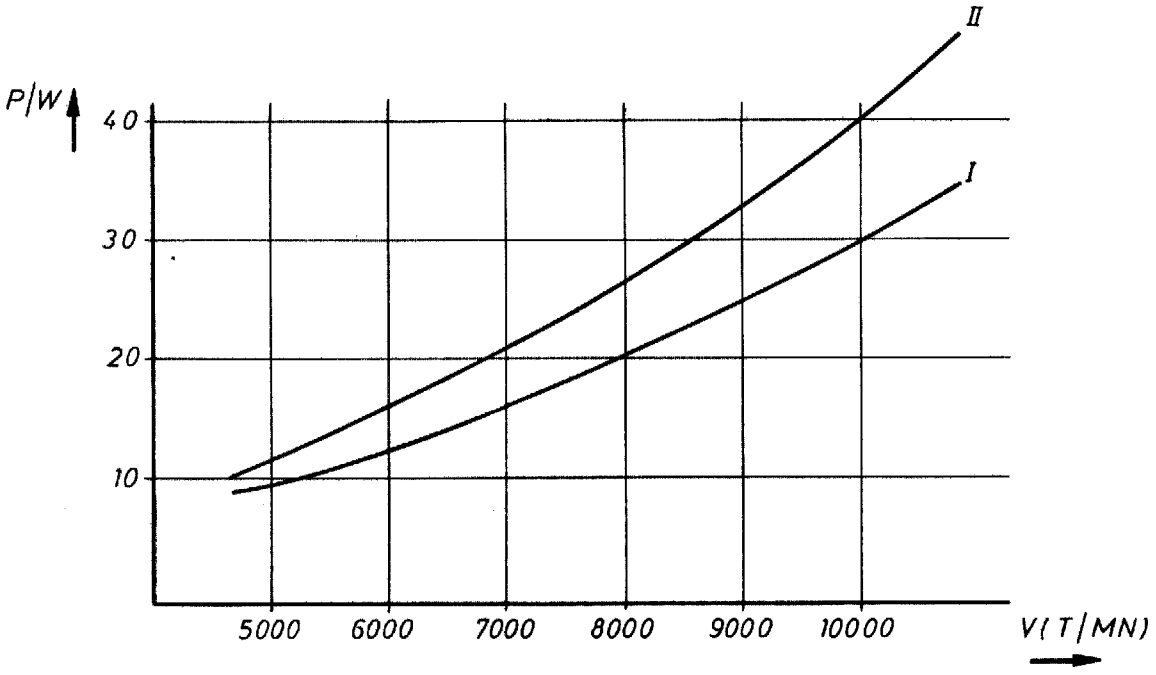

Fig. 1
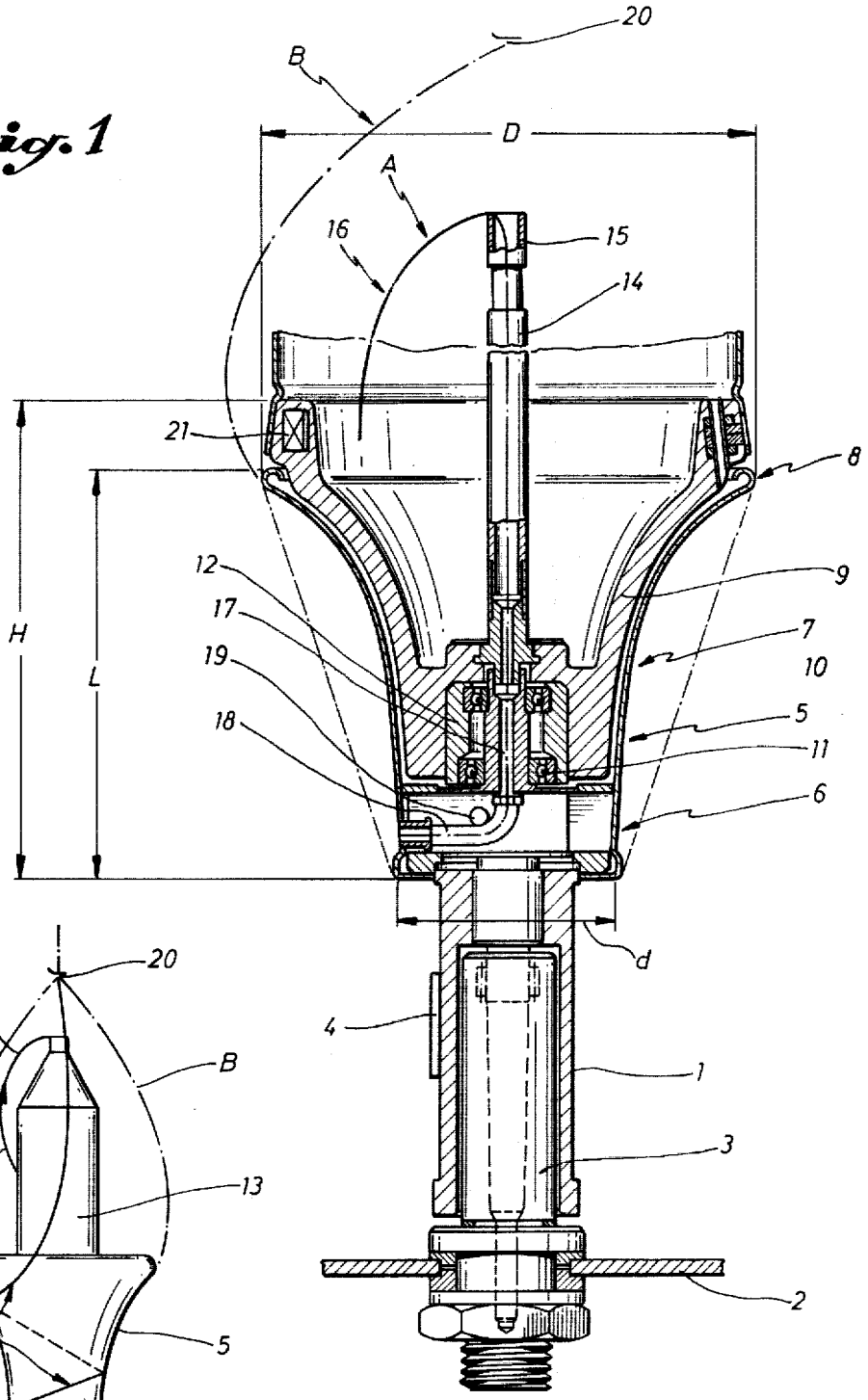
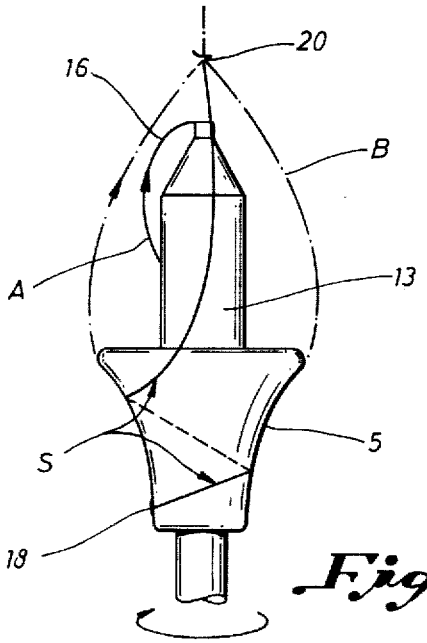
Fig. 2

DEVICE FOR TWISTING A YARN BY MEANS OF A DOUBLE TWIST DEVICE

The invention relates to a device for twisting a yarn by means of a double twist device, commonly referred to as a "double twist spindle". This designation will accordingly be used in the specification. Double twist spindles are also sometimes known as "two-for-one spindles".

In the general description of the invention in this specification, to facilitate discussion of the invention, double twist spindles have been described which are mounted to extend vertically during use. It will be appreciated, however, that this invention will apply equally to such spindles whether they are mounted either horizontally or at a slant and that the invention is therefore not limited to the attitude in which the spindle will be mounted for use.

Broadly speaking, double twist spindles comprise essentially:

a vertical shaft driven in rotation for example by a tangential belt system and maintained on a machine frame by means of a bearing such as a step-bearing;

a package carrying assembly mounted for rotation freely and independently of the shaft at the end of the shaft, and maintained in an immobile condition with respect to the shaft by, for example, a magnetic retaining device, the package carrying assembly being designed to receive a yarn bobbin containing yarn to be twisted, and including a hollow axle which is coaxial with the shaft, a base, and a protecting bowl which is fitted to an extends from the base; and a rotating element integral with the rotatable shaft, situated below the package carrying assembly, and including a yarn conduit for the passage of yarn, the conduit having a yarn outlet.

Yarn unwound from a bobbin positioned in the package carrying assembly, is threaded through the hollow axle of the assembly, and forms a first or inner balloon between the bobbin and the axle. The yarn then passes through the conduit of the rotating element, out of its outlet, and then through a yarn anti-balloon centering guide arranged along an extension of the spindle axis, the yarn forming a second or outer balloon between the yarn outlet of the rotating element and the yarn guide. Thereafter the yarn passing through the yarn guide is wound up in a conventional manner.

Double twist spindles have been known for a long time and have been the subject of many publications particularly in French Pat. Nos. 878,641, 885,434, 57,274 (second addition to French Pat. No. 955,185), in the British Pat. Nos. 618,028 and 989,608, as well as in the U.S. Pat. Nos. 2,207,574 and 3,640,060.

Furthermore, in the French Pat. No. 1,597,961 (corresponding to the U.S. Pat. No. 3,685,269), particularly in order to reduce the yarn tensions to which the yarn is submitted, it has been proposed to utilize as rotating element, a conical bowl which surrounds the package along part of its height, the yarn resting against the surface of the aforesaid bowl in a perceptibly helical fashion before forming the outer or second balloon.

Such a device presents many advantages and particularly permits an increase in the spindle rotating speed for an equivalent yarn tension, or permits delicate yarns which should be submitted to low tensions, to be processed at the same speeds as other yarns. Furthermore, such a device allows the height of the balloon to be substantially reduced and consequently allows the required space taken by the equipment to be reduced.

An improved device has now been invented, which, while keeping the advantages of the conical bowl spindle of the above mentioned type, leads to a much lower power consumption, to a much more regular unwinding of yarn, and allows processing of a larger yarn count range while preserving a minimum tension to the yarns processed.

It is accordingly an object of this invention to provide a double twist spindle which can provide one or more of the advantages indicated.

According to this invention there is provided a double twist spindle comprising:

a shaft adapted to be rotatably driven, the shaft having a first end to be rotatably mounted on a machine frame;

a package carrying assembly rotatably mounted proximate the opposed free end of the shaft for rotation independently of the shaft, the assembly including a base, a protecting bowl extending from the base, and a hollow axle coaxial with the shaft;

retaining means for retaining the assembly against rotation with the shaft; and a bowl element mounted at the free end of the rotatable shaft for rotation with the shaft, the bowl element comprising a hollow bowl which extends around the package carrying assembly, and has a conduit defining a yarn passage with a yarn outlet;

the hollow bowl having a first part of truncated conical shape in the region of the yarn outlet, the first part having a gradual slope, and the hollow bowl extending from the first part into a concave bell mouthed configuration.

The first truncated conical part which has a gradual slope, may conveniently extend over about one-third to about one-half of the overall bowl height and have a slope between 0 and 15%.

In use, yarn emerging from the conduit outlet will be wound along the outer surface of the hollow bowl in helical fashion before forming the outer or second balloon between the hollow bowl and an anti-balloon centering guide arranged along an extension of the spindle axis.

The overall configuration of the hollow bowl of this invention will therefore tend to generally have the shape of a horn, a megaphone or the like. The first part of the hollow bowl of this invention, which is of truncated conical configuration has, as indicated, a gradual slope.

The walls of the hollow bowl defining the first part may be linear, or may be smoothly curved to define the truncated conical first part and to extend smoothly into the concave bell mouthed configuration of the remaining portion of the hollow bowl.

The free end of the bell mouthed portion of the hollow bowl according to the invention, may preferably be inwardly curved towards the interior of the bowl to facilitate yarn clearing from the hollow bowl during formation of the second or outer balloon during use.

The yarn guiding conduit of the hollow bowl may conveniently comprise one part which lies along an extension of the axis of the hollow axle of the package carrying assembly, and a second part which extends transversely therefrom to the surface of the first part of the hollow bowl to define the yarn outlet. In this embodiment a yarn diverting element, which may for example be formed out of a ceramic material, may be arranged in an elbow formed between the first and second parts of the yarn guiding conduit.

A preferred embodiment of the invention is now described by way of example with reference to the accompanying drawings:

FIG. 1 is a detailed longitudinal cross-sectional view of a double-twist spindle according to this invention, FIG. 2 is a schematic view illustrating the functioning of such spindle, FIG. 3 is a diagram showing the power consumption curve in relation to the rotation speeds for one spindle consistent with the invention (curve 1) and for a similar spindle consistent with French Pat. No. 1,597,961 (curve 2) in which the bowl has a truncated cone shape.

The double twist spindle according to this invention comprises a rotatable shaft 1 having one end rotatably mounted on a frame 2 of a machine by means of a step bearing 3. The shaft 1 is rotatably driven for example by means of a tangential belt 4.

A bowl element 5 in accordance with this invention is mounted at the other end or free end of the shaft 1. The bowl element 5 is integral with the free end of the shaft 1 for rotation therewith.

The bowl element 5 is in the form of a hollow bowl having an axis of rotation which is coaxial with that of the shaft 1.

The hollow bowl of the bowl element 5 has a first part 6 which is of truncated conical shape, and which has a very gradual taper. The hollow bowl further comprises a second part 7 which extends from the diverging end of the first part 6 and has a concave bell mouthed configuration.

The free end or upper part 8 of the bowl element 5, that is at the free end of the bell mouthed part 7, is curved inwardly towards the interior of the bowl element 5.

A fixed package carrying assembly 9 is positioned within the bowl element 5.

The package carrying assembly 9 is mounted for free rotation via ball bearing assemblies 10 and 11, for rotation freely and independently of the axle or rotating shaft 1 and the bowl element 5.

The device includes retaining means for retaining the assembly 9 against rotation with the shaft 1. The retaining means may be of any conventional type such as, for example, magnetic means 21 as shown in FIG. 1.

The package carrying assembly 9 comprises a base 12 for supporting one end of a bobbin supporting yarn to be processed, when located in the assembly 9.

For the sake of clarity, a bobbin is not shown in FIG. 1 of the drawings. However, a bobbin is illustrated in FIG. 2 and is identified by reference 13.

The assembly 9 may include a protecting bowl removably located thereon to protect a bobbin 13 when located therein. Only the lower portion of such a protecting bowl is shown in FIG. 1 of the drawings located on the part of the assembly 9 which houses the magnetic means 21.

The package carrying assembly 9 further includes a hollow axle 14 which extends from the base 12, and which has an upper part 15 of conventional type having means for locking the twist communicated to yarn 16 when unwound from a bobbin 13.

The bowl element 5 includes a yarn guiding conduit 17 which communicates with a transversely extending guiding conduit 18. The conduit 18 terminates at a yarn outlet on the surface of the part 6. A yarn diverting element 19 is positioned at the region of the elbow which is formed between the yarn guiding conduits 17 and 18.

The hollow axle 14 has its bore arranged to be in line with the axis of the yarn guiding conduit 17.

In use, when a bobbin 13 containing yarn 16 to be processed has been positioned in the package carrying assembly 9 about the hollow axle 14, yarn 16 wound off the bobbin 13 forms a first or inner balloon A, passes through the bore of the hollow axle 14 through the yarn guiding conduit 17, and then through the conduit 18 to emerge from the bowl element 5 through the outlet of the conduit 18.

The yarn emerging from the outlet of the conduit 18 becomes wound in helical fashion along the outer surface of the bowl element 5 [as indicated by S in FIG. 2] up to the point where the yarn 16 leaves the surface of the bowl element 5 at its upper or free end. The yarn 16 then forms a second or outer balloon B before being led to the yarn guide 20 which is positioned along the extension of the axis of the hollow axle 14, and which is of conventional type. Beyond the yarn guide 20, the processed yarn is wound in conventional manner.

Thus, for each rotation of the spindle, the yarn will receive a first twist during its passage form its unwinding point on the bobbin 13 and the top or upper part 15 of the hollow axle 14. Thereafter, it receives a second twist in the outer or second balloon B between leaving the outer surface of the bowl element 5 adjacent the upper part 8 and the yarn guide 20.

As is clearly evident from FIG. 3 of the drawings, the device in accordance with this invention presents a distinct advantage over the previously known device as illustrated in French Pat. No. 1,597,961 in that it has a much lower power consumption. Curve 1 in FIG. 3 illustrates the power consumption of a double twist spindle equipped with a magazine element 5 in accordance with this invention, while curve 2 illustrates the power consumption of a corresponding double twist spindle but which is equipped with a magazine element having a truncated cone shaped [represented by a dotted line in FIG. 1] of the type illustrated in French Pat. No. 1,597,961.

Using such spindles having the following characteristics:

height H: between 80 and 170 mm;

length L of the magazine element 5: between 40 and 80 mm;

outer diameter D: between 100 and 160 mm; and inside diameter d: between 30 and 80 mm, synthetic and artificial yarn packages have been processed weighing between 0.8 and 4 kgs, having a length between about 250 and 500 mm, and a diameter between 70 and 150 mm.

The curves 1 and 2 of FIG. 3 show that at 6,000 revolutions per minute, a spindle according to the invention [curve 1] absorbs power of about 13 watts, whereas with a magazine bowl having a truncated cone shaped [curve 2] the power absorbed is of the order of about 15 watts. In both cases, tensions of the yarns were identical.

From experiments conducted by applicants, it has been established that with the specific magazine element in accordance with this invention, it is possible to substantially reduce the power consumption while still retaining the advantages of previously known spindles of the type described particularly in French Pat. No. 1,597,961.

From these experiments it was found that the invention provided the further advantages of permitting more regular unwinding of yarn, and permitting the processing of a wider yarn count range while keeping a minimum yarn tension during the process.

I claim:

1. A double twist spindle comprising:

(a) a shaft adapted to be rotatably driven, the shaft having a first end to be supported on a machine frame;

(b) a package carrying assembly rotatably mounted co-axially with the shaft for rotation independently of the shaft, the assembly including a base for supporting an end of a bobbin, and a hollow axle co-axial with the shaft;

(c) retaining means for retaining the assembly against rotation with the shaft; and (d) a bowl element fixed to a second end portion of the shaft for rotation with the shaft, the bowl element comprising a hollow bowl which is co-axial with the shaft, which extends around the package carrying assembly, and which has a conduit defining a yarn passage with a yarn outlet;

the hollow bowl having a first part which is of truncated conical shape in the region of the yarn outlet, the first part having a gradual slope, and having a further part which extends from the diverging end of the first part, the further part having a concave bell-mouthed configuration.

2. A double twist spindle according to claim 1, in which the first part extends over between about one-third and one-half of the length of the hollow bowl.

3. A double twist spindle according to claim 1, in which the retaining means comprises magnetic means.

4. A double twist spindle according to any one of claims 1 to 3, in which the conduit defining the passage comprises a first part which is co-axial with and in line with the bore of the hollow axle of the package carrying assembly, and a second part which extends transversely from the first part and terminates in the yarn outlet.

5. A double twist spindle according to claim 4, in which a yarn diverting element is positioned at the junction of the first and second parts of the conduit.

6. A double twist spindle according to claim 1, including a protecting bowl removably located on the package carrying assembly.

* * * * *